US005515610A

United States Patent [19]

Levin et al.

[11] Patent Number: 5,515,610

[45] Date of Patent: May 14, 1996

[54] FOLDING KNIFE WITH LOCKING SPRING INTEGRAL WITH BLADE

[76] Inventors: Yakov Levin, 7216 Bay Pkwy.; Erika Polyakova, 201 Brighton 1st Rd., Apt. 3R, both of Brooklyn, N.Y. 11235

[21] Appl. No.: 339,546

[22] Filed: Nov. 15, 1994

[51] Int. Cl.[6] ..... B26B 1/02

[52] U.S. Cl. ..... 30/161; 30/155

[58] Field of Search ..... 30/155, 160, 161

[56] References Cited

U.S. PATENT DOCUMENTS

| | | | |
|---|---|---|---|
| 4,040,181 | 8/1977 | Johnson | 30/161 |
| 5,044,079 | 9/1991 | Gibbs | 30/160 |
| 5,093,995 | 3/1992 | Jan | 30/161 |
| 5,095,624 | 3/1992 | Ennis | 30/161 |
| 5,293,690 | 3/1994 | Cassady | 30/161 |

FOREIGN PATENT DOCUMENTS

| | | | |
|---|---|---|---|
| 2146066 | 4/1973 | Germany | 30/161 |

*Primary Examiner*—Hwei-Siu Payer

[57] ABSTRACT

A folding knife has a generally elongate blade having a tang portion formed with an integral normally unstressed cantilever spring. A cam pin is provided within the blade receiving space within the handle which is disposed along a curvilinear path defined by a locus of points traveled by a free end of the spring as the blade pivots from the closed to the open positions. The cam pin serves to engage and obstruct the free end of the spring between a first point on the curvilinear path when the blade approaches the open position and a second point on that path when the blade reaches the fully open position. The spring, while obstructed is deflected by the cam pin toward the blade into a gap defined by an end edge of the blade and the spring. Such deflection enables the spring to move past the cam pin. The spring is only stressed when deflected by the cam pin, so that the spring tends to initially resist fully opening the blade and, once the blade is fully open tends to maintain the blade in the open position and resist closure of the blade.

20 Claims, 2 Drawing Sheets

FOLDING KNIFE WITH LOCKING SPRING INTEGRAL WITH BLADE

BACKGROUND OF THE INVENTION

1. Field of the Invention

This invention generally relates to cutlery, and, more specifically, to a folding knife that includes a locking spring that is integral with the blade.

2. Description of the Prior Art

Folding knives, especially of the pocket or hobby type, are generally provided with at least one locking mechanism for maintaining the blade in the open or fully extended position. Such locking mechanisms are used not only for facilitating the use of such knives but to enhance the safety in their use. Numerous mechanisms have been proposed to accomplish this objective. Two such mechanisms are illustrated in FIGS. 1–3.

A first mechanism is exemplified in FIGS. 1 and 2. In FIG. 1 a pocket knife is shown partially opened while FIG. 2 shows another knife of this type in the Fully open or extended position. Similar or identical parts are designated by the same reference numerals throughout. The knives are designated by the reference numerals 10, and include a handle 12 and an elongate folding blade 14 which is pivotally mounted on the handle 12 by means of a pivot pin 16. The blade 14 has a cutting edge 18 and an opposing edge 20 that meet at a point 22 at one end of the blade. An elongate groove or "common nail mark" is generally provided along the edge 24 which is normally accessible externally of the handle even when the blade is in the closed position and housed in a blade receiving space 12' of the handle 12 to thereby permit gripping of the blade with one's fingernail for opening the blade. The blade is pivoted at an end opposite to the pointed end which is commonly referred to as the "blade tang" 26. As will be noted, the blade tang is provided with a rounded end 28 and a cutout or "back square" 30 which defines a generally transverse stop surface or "run up" 32. Provided along one edge of the handle 12 is an elongate spring 34 having one end rigidly secured to the handle 12 by means of suitable fasteners such as rivets 36, 38. The other or free end 40 extends along the handle as shown and is provided with a generally transverse stop surface 40' which is dimensioned and oriented to mate with the surface 32 when the blade is in the fully open position as shown in FIG. 2. As is well known to those skilled in the art, the tang 28 is shaped in the form of a cam that applies a pressure to the spring end 40 when the blade is opened to urge the spring end outwardly, such pressure and movement typically peaking when the blade is approximately 90° to the direction of the handle. The spring end 40, which acts as a cam follower, applies a counter force on the blade when it is placed under stress in this manner. The blade tang 26 is so shaped that the counter force applied by the spring tends to close the blade when it is partially closed, as suggested in FIG. 1, or tends to open the blade when it is mostly opened (i.e. when the blade extends an angle greater than 90° with the handle.) When the handle is fully open as shown in FIG. 2 the spring end 40 is received within the cutout or notch 30 at which time the stress in the spring end 40 is fully eliminated. Any attempt to close the blade 14 from the position shown in FIG. 2 will be countered by the spring since this will again apply a stress to the spring. While the spring counter force can be overcome, and is overcome when the knife is to be closed, it is clear that the spring 34 serves as a locking device that inhibits free movement of the blade from the open position.

In FIG. 3, a similar knife 10' is shown, in which the spring 34 is replaced with two elements 34A and 34B. The element 34A, which may be although need not be resilient, is pivotally mounted on the handle 12' by means of pivot pin 38. The element 34B is a cantelever leaf spring having one end rigidly secured to the handle 12' by means of a spacer plate 42 which is itself secured to the handle by means of any suitable fasteners such as rivets 44. The other end of the spring 34B is arranged proximate to the rear portion of the element 34A (that portion between the pivot pin 38 and the spacer plate 42). As is well known to those skilled in the art, when the element 34A is in the position shown in FIG. 3, the spring 34B is unstressed. However, when the element 34A is rotated about the pivot pin 38 in a clockwise direction (as viewed in FIG. 3) the spring 34B is deflected and the stresses developed in the spring 34B urge the element 34A to remain in the position shown in FIG. 3. The front end of the element 34A (that portion to the left of the pivot pin 38 as viewed in FIG. 3) is provided with an inwardly directed rectangular projection 46 dimensioned and configurated to be received within a similarly shaped and configurated cutout 48 in the tang 26'. When the blade is in the open position the projection 46 prevents the free movement of the blade from the open position, the element 34A acting as a locking element. To close the blade the user must apply a pressure "P" as shown in FIG. 3 to overcome the counter force of the spring 34B, thereby rotating the element 34A sufficiently to remove the projection 46 from the cutout 48, thereby releasing the blade 14' and permitting same to be moved to the closed position. A folding knife employing such an arrangement is disclosed in U.S. Pat. No. 5,044,079.

Another locking device for a folding knife is disclosed in U.S. Pat. No. 5,293,690, in which a spring loaded crossbolt is fitted to the blade tang. One end of the crossbolt protrudes through an arcuate slot in the handle. A locking collar on the crossbolt engages locking counterbores located on the blade side of the opposite ends of the crossbolt slot. When finger pressure is applied to the end of the crossbolt, the locking collar is forced to disengage the locking counterbore and retreat to a relieved area on the blade. This permits the blade to be extended by forward finger pressure on the crossbolt. When the blade is fully extended, spring pressure forces the locking collar into the opposite locking counterbore, thus locking the blade. Reversing the sequence will close and lock the blade.

The disadvantages of the known constructions include the need for the handling and assembly of additional elements or components, including at least one spring, such as the spring 34 (FIGS. 1 and 2) or two or more springs or elements such as elements 34A and 34B (FIG. 34B.) Also, in addition to the extra cost of assembly, the use of additional parts represents an additional expense for a knife which has a relatively few number of elements. Therefore, the extra or separate springs or the like represent a significant percentage cost increase, particularly since the separate spring elements must be made of good quality spring steels. Additionally, when such extra elements are housed within the blade receiving space within the handle there is that much less room or flexibility within the handle to provide additional or auxiliary locking mechanisms for insuring that the blade will not inadvertently open when it is in the closed position.

SUMMARY OF THE INVENTION

Accordingly, it is an object of the present invention to provide a folding knife which does not have the disadvantages inherent in comparable prior art knives.

It is another object of the invention to provide a folding knife which is simple in construction and economical to manufacture.

It is still another object of the invention to provide a folding knife which dipenses with separate spring or associated locking elements for maintaining a knife blade in the full extended or open position.

It is yet another object of the invention to provide a folding knife of the type suggested in the previous objects which employs a single spring which is integrally formed on the knife blade.

It is a further object of the invention to provide a folding knife as aforementioned which is lighter in weight and provides more space within the handle to house secondary or auxiliary blade locking mechanisms.

In order to achieve the above objects, and others which will become evident hereinafter, a folding knife in accordance with the present invention comprises a generally elongate blade which has a tang portion which defines an edge and forms a normally unstressed cantilever spring integrally connected at one end to said tang portion in spaced relation to said end edge to form a gap with said end edge, and has an other free end. A handle is provide which has a blade receiving space for receiving the blade in a closed position of the blade. A pivot pin is provided for pivotally mounting the blade at the tang portion for movement of the blade between open and closed positions of the blade, the free end defining a generally curvilinear path as the blade and spring are moved between closed and open positions. Cam means is provided within the blade receiving space which is at least partially disposed along the curvilinear path for engaging and obstructing the free end of the spring while the free end is in contact with the cam means between first and second points along the curvilinear path, the spring only being under stress and deflected into the gap to move past the cam means when the free end moves between the first and second points along the path. The cam means engages the free end of the spring approximatelly at the second point in the fully open position of the blade to prevent free movement of the free end and the blade itself from the open position towards the closed position of the blade.

BRIEF DESCRIPTION OF THE DRAWINGS

Further objects and advantages of the invention will become evident to those skilled in the art from a detailed description of a presently preferred embodiment of the invention, with specific reference to the following figures.

DESCRIPTION OF PREFERRED EMBODIMENTS

Figure 4:
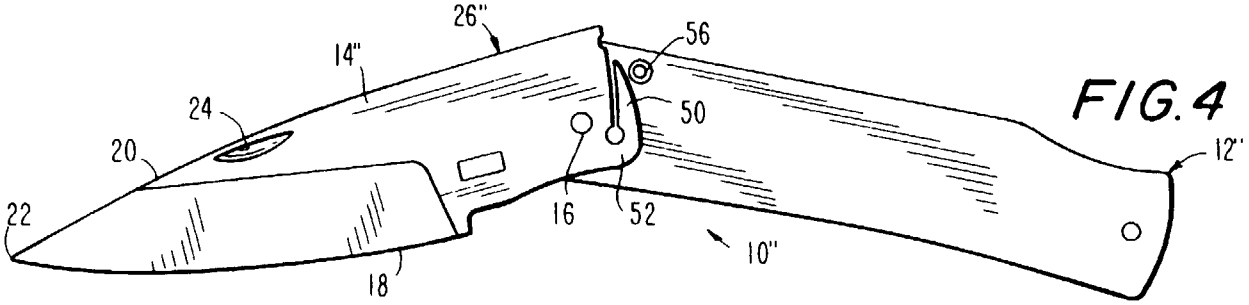
FIG. 4 is similar to FIGS. 1–3, but showing a folding knife in accordance with the present invention, showing the blade in an almost fully open position and showing the manner in which a locking spring integral with the blade engages a cam pin mounted on the handle.

Refering now specifically to FIG. 4, a presently preferred embodiment 10" of the invention is shown which includes a handle 12" which supports a blade 14" pivotally mounted at tang 26" by means of pivot pin 16. The tang 26" has an end edge 49 (FIG. 6) which is oriented in a direction generally normal to the length direction of the blade 14". The knife 10" includes a normally unstressed spring 50 which is integrally formed with the blade 14" and cantelever mounted to the lower 52 end of the end edge 49 of the tang portion 26", as viewed in FIG. 6, in spaced relation to the end edge 49 to form a gap 54 with the end edge 49. The spring 50 has another, free end **50*a* which projects almost the entire length of the end edge 49 but stops short of the edge 20" a distance substantially equal to the diameter of a cam pin 56**, as shown.

Figures 1, 2, 3, 7:
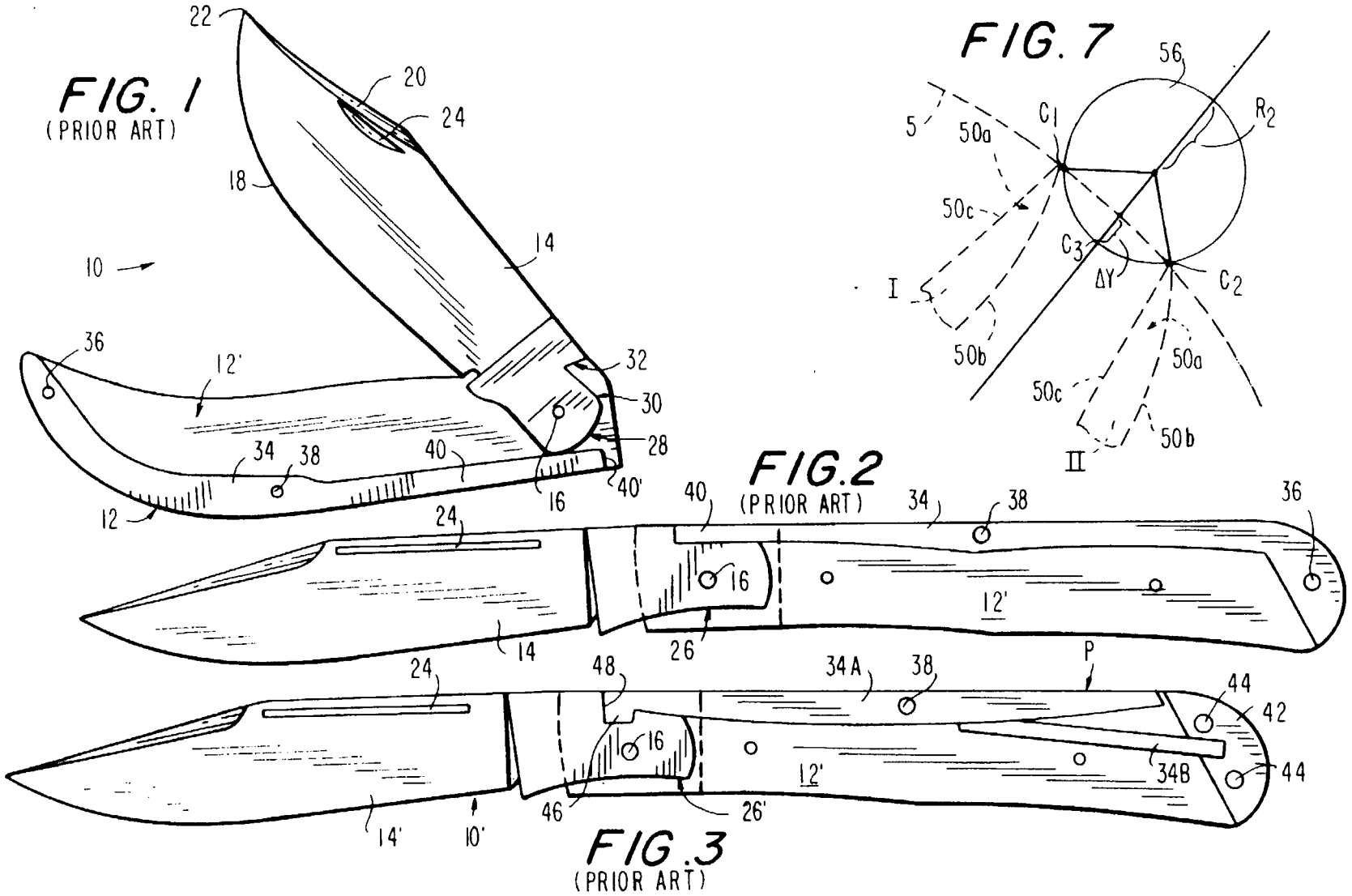
FIG. 1 (PRIOR ART)
FIG. 2 (PRIOR ART)
FIG. 3 (PRIOR ART)
FIG. 1 is an illustration of a conventional folding pocket knife, with one side of the handle removed, showing the manner of cooperation of a locking spring and the blade in a partially open position of the blade.
FIG. 2 illustrates a folding knife similar to the one shown in FIG. 1 in which the blade is in the fully open or extended position.
FIG. 3 is a view similar to FIGS. 1 and 2, but showing a different known locking spring arrangement.
FIG. 7 is an enlarged view of the cam pin and illustrating the geometries involved in the operation of the locking arrangement.

The pivot pin 16 pivotally mounts the blade 14" at the tang portion 26" for movement of the blade 14" and the spring 50 between open and closed positions, the free end **50*a* defining a generally curvilinear path S as the blade and the spring are moved between closed and open positions. The cam pin 56, which is only illustrative of any suitable cam means that can be used and will become apparent to those skilled in the art from the disclosure herein, has an axis which is parallel to the axis of the pivot pin 16 and is arranged within the blade receiving space with the tang portion 26". The cam pin is at least partially disposed along the curvilinear path S for engaging and obstructing the free end 50*a* of the spring only while the free end 50*a* is in contact with the cam pin between first and second points $C_1$ and $C_2$ along the curvilinear path S, as shown in FIG. 7. As evident from FIGS. 6 and 7, the curvilinear path S consists of a locus of points defined by the free end 50*a* as it moves about pivot pin 16**.

More specifically, the spring 50 has an exterior or external edge **50*b* and an internal edge 50*c* that meet at point or tip 50*d*, and the path S is shown as the locus of points defined by the point 50*d*. When the free end 50*a* reaches point $C_1$ the cam pin 56 blocks or obstructs the free movement of the spring 50 towards the point $C_2$. However, a force applied to the blade 14" by the user to rotate the blade in a clockwise direction (as viewed in FIGS. 6 and 7) causes the spring 50 to be deflected in a counterclockwise direction about center 58 into the gap 54 to clear or move past the obstruction represented by the cam pin 56. It will be clear that with a cam in the form of a circular cylindrical pin of the type shown the spring 50 will initially be unstressed at point $C_1$, peak at maximum stress and deflection at point $C_3$ and drop to zero stress and deflection at point $C_2$. The reason for this is because the cam pin 56 defines a circular arc which projects into the path of movement of the free end 50*a***, with minimum obstuctions being present at points $C_1$ and $C_2$ while a maximum obstruction being present at $C_3$.

The external edge **50*b* is preferably curved as shown to facilitate sliding movements of the free end 50*a* past the cam pin 56 while being deflected thereby. To enhance the flexibility or resiliency of the spring 50 there is advantageously provided a circular cutout 60 as shown which has a diameter preferably greater than the width of the gap 54** to enhance the flexibility of the spring.

Figure 5:
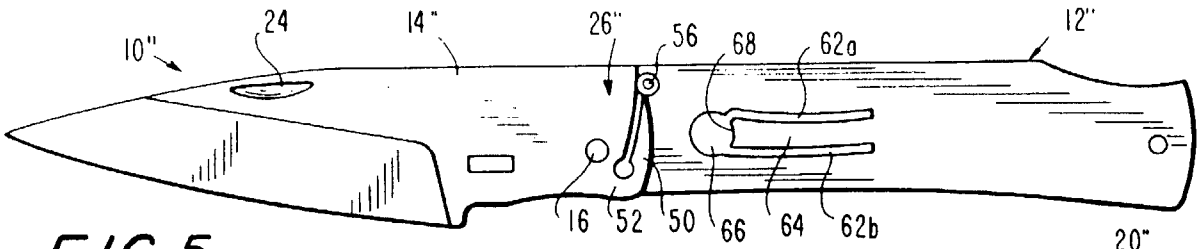
FIG. 5 is similar to FIG. 4, but showing the blade in the fully open position and the spring and cam pin combination function to lock the blade in the open position.
Figure 6:
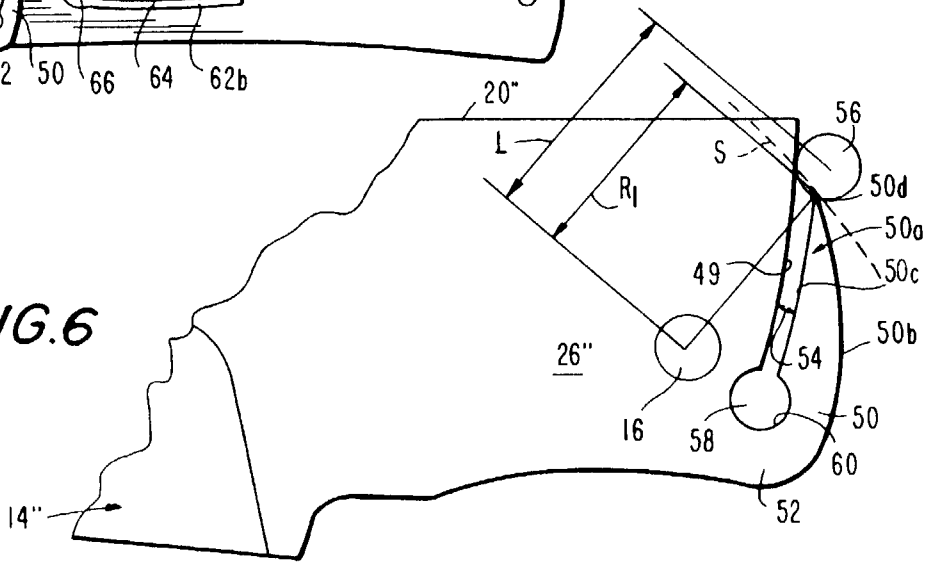
FIG. 6 is an enlarged view of the tang portion of the blade, illustrating the details of the integral spring and the manner that it cooperates with the cam pin.

As suggested, when the free end 50*a* moves from position I to position II the end edge 49 comes into contact with the cam pin 56 which also serves as a stop pin to prevent further clockwise rotation of the blade once it reaches the position shown in FIGS. 5 and 6. At that point, it will be clear, the cam pin engages the free end approximately at the second point $C_2$ along the path S when the spring 50 becomes unstressed. Since a reverse motion of the blade in a counterclockwise direction towards the closed position again entails stressing the spring, the spring 50 prevents free movement of the free end and the blade from the open position towards the closed position of the blade.

As best shown in FIG. 6 the gap 54 has a substantially uniform width. However, this is not critical and other gap configurations can be used as long as the gap allows for sufficient defection of the spring to move past the cam pin. As suggested in FIGS. 6 and 7, the arc defined by the points $C_1$ and $C_2$ may vary depending on the geometries and the dimensions of the relevant components. However, it is presently preferred that the arc included by the contact points is approximately 90°, although this dimension is not critical and may vary while still achieving the objects and advantages of the invention. Thus, in designing the knife it must be understood that the free end 50*a* must be able to deflect into the gap 54 and slide between points $C_2$ and $C_1$. This necessarily means that the point 50*d* of the spring cannot be positioned at a point along the cam pin 56 which will either result in a normal force being applied against the cam pin 56 when an effort is made to close the blade or result in a force which will tend to open the spring 50 (pivot relative to the center 58 in a clockwise direction.) The first possibility would result in a total locking of the blade since the spring would be frozen and would not deflect about the center 58 in an effort to clear the cam pin. With the second possibility, the spring would be urged in the wrong sense or direction, to enlarge the gap and receive the cam pin within the gap 54. Excessive force applied with both possibilities would result in damage to or snapping of the spring from the blade. Therefore, the arc of the cam pin must be selected to insure that any force applied to the blade to close the same will result in a force component applied to the spring 50 which will rotate the spring in a counterclockwise direction, as viewed in the Figures, to urge the spring into the gap thereby allowing the spring to clear or pass by the obstruction represented by the cam pin in the same manner as the spring was deflected in initially opening the blade. Such a result can be achieved with the geometry shown where the width of the gap 54 is approximately equal to a predetermined dimension substantially equal to the radius of the cam pin 56.

Referring to FIGS. 6 and 7, if the centers of the pivot and cam pins 16 and 56, restpectively, are spaced a distance L, the radius of curvature of the curvilinear path S is $R_1$ and the radius of the cylindrical cam pin 56 is $R_2$ the maximum obstruction Δy is equal to $$\Delta y=(R_1+R_2)-L.$$

Since this is the maximum obstruction Δy is also approximately equal to the maximum deflection of the free end of the spring 50*a* in order to clear or pass by the cam pin. In the presently preferred embodiment, the distance L is preferably within the range of 7–13 times the width of the gap 54, with a ratio of 10:1 providing very satisfactory results. It will also be evident that the greater Δy the greater the "snap" or "click" that the user will sense as the blade is fully opened-this providing a more positive tactile feedback that some users may prefer. As suggested, however, the extent to which Δy can be increased is limited by the maximum desired force to be applied to the blade to open it, the ability of the blade to be deflected a greater degree to accomodate a larger Δy without breaking the spring and the size of the gap which must receive the spring in its maximum deflected state.

The pivot pin 16 and the circular cutout 60 are generally disposed at one end of the end edge 49 while the cam pin 56 is positioned to abut against the other end of the end edge. In this way maximum leverage is provided for defecting the spring 50 and for minimizing the forces that need to be applied by the user in opening or closing the blade.

For optimum operation, the working components should have hardness factors within prescribed relative ranges. Thus, the hardness of the spring 50 should be less than the hardnesses of the cam pin 56 and of the blade 14. Thus, it has been determined that hardness factors that are acceptable for satisfactory operation are approximately 50 RC (Rockwell) for the spring 50, while the pin and blade are preferably within the range of 58–60. Such hardness factors will provide extended and reliable operation of the knife and require forces by the user to open the blade (to bypass the pin 56) of approximately one pound of force.

While the spring 50 has been shown as a generally straight elongate member, it will become evident to those skilled in the art from the disclosure herein that the specific configuration is the spring is not critical and the spring can have a different shape, be shorter or longer than shown and may be rigidly affixed to the blade (although in the preferred embodiments the spring is integrally formed), as long as the spring performs the functions and provides the results described herein.

Referring to FIG. 5, a pair of spaced parallel slots 62*a* and 62*b* are shown formed in the handle 12" to define a spring member or tine 64 which is normally bent into the blade receiving space. A circular opening 66 is formed at one end of the spring member 64 to define a contoured edge 68 at the end of the member. The member 64 may be formed in the handle itself when the handle is made from spring steel or may be formed from a spring steel liner or plate when the handle is formed of a non-spring material. The spring member serves as a locking element which cooperates with a complementary feature on the blade, such as a suitably shaped recess in the blade to accept the member 64. However, the locking element or spring member 64 need not be received within a recess in the blade but may simply apply a pressure on the closed blade to frictionally maintain the blade closed until the user overcomes the frictional retaining force when the blade is withdrawn from the handle. Thus while the member 64 can be used to maintain the blade in the fully closed position, the cam pin 56 keeps the blade in the open position. The member 64, or any other equivalent closed blade locking arrangement, should be used since, clearly, the spring 50 cannot be used to keep the blade in a closed position. Unlike the conventional knives, of the type shown in FIGS. 1–2, in which the same spring 34 is used to maintain the blade in both the open and closed positions, the spring 50 of the present invention is only useful in the open position of the blade.

While the invention has been described in terms of specific embodiments, it will be clear to those skilled in the art that various modification to the described embodiments may be made without departing from the spirit of the invention, so that the invention is to be limited only by the scope of the claims that are appended hereto.

What is claimed is:

1. A folding knife comprising a generally elongate blade having a tang portion defining an end edge and forming a normally unstressed cantilever spring integrally connected at one end to said tang portion in spaced relation to said end edge to form a gap with said end edge and having a, free end; a handle having a blade receiving space for receiving said blade in a closed position of said blade; a pivot pin pivotally mounting said blade at said tang portion for movement of said blade between open and closed positions, said free end defining a generally curvilinear path as said blade and said spring are moved between closed and open positions; and cam means within said blade receiving space and at least partially disposed along said curvilinear path for engaging and obstructing said free end of said spring only while said free end is in contact with said cam means between first and second points along said curvilinear path, said spring only being under stress and being deflected into said gap to move past said cam means when said free end moves between said first and second points, said cam means engaging said free end at said second point in the fully open position of said blade to prevent free movement of said free end and said blade from the open position towards the closed position of said blade.

2. A knife as defined in claim 1, wherein said end edge extends along a direction substantially normal to the length direction of said blade.

3. A knife as defined in claim 1, wherein said free end has an internal edge opposing said end edge of said tang portion to define said gap.

4. A knife as defined in claim 3, wherein said free end has a curved external edge dimensioned to slidably contact said cam means.

5. A knife as defined in claim 1, wherein said gap has a substantially uniform width.

6. A knife as defined in claim 1, wherein said cam means comprises a cam pin having a cross-sectional cross-section and an axis generally parallel to the axis of said pivot pin.

7. A knife as defined in claim 6, wherein said end edge abuts against said cam pin in the fully open position of said blade, whereby said cam pin also serves as a stop for said blade to prevent further rotation of said blade about said pivot pin relative to said handle once said blade is fully open and substantially coextensive with the length direction of said handle.

8. A knife as defined in claim 1, wherein said cam means has a circular cross-section.

9. A knife as defined in claim 8, wherein said cam section that contacts said spring is defined by an arc enclosed by an angle of approximately 90°.

10. A knife as defined in claim 1, wherein said second point is situated on a portion of said cam means which generates a deflection force on said free end when said blade is forced from the open towards the closed positions, whereby said spring is deflected into said gap to allow said spring to move past said cam means.

11. A knife as defined in claim 1, wherein the radius of curvature of said curvilinear path is $R_1$ and said cam means comprises a cam pin having a radius of $R_2$ and the distance between the centers of said curvilinear path and said cam pin is equal to L, the amount of deflection $\Delta y$ being on the order of magnitude of $$\Delta y=(R_1+R_2)-L.$$

12. A knife as defined in claim 1, wherein said cam means is a cylindrical pin having an axis substantially parallel to the axis of said pivot pin and having a radius equal to a predetermined dimension, and said gap having a dimension between said end edge and said spring approximately equal to said predetermined dimension.

13. A knife as defined in claim 1, wherein the distance between said pivot pin and said curvilinear path is within the range of 7–13 times the width of said gap.

14. A knife as defined in claim 13, wherein said distance is approximately 10 times the width of said gap.

15. A knife as defined in claim 1, wherein said spring has a center of deflection substantially within the region defined by said gap.

16. A knife as defined in claim 15, wherein a circular cutout is centered about said center of deflection which has a diameter greater than the width of said gap to enhance the flexibility of said spring.

17. A knife as defined in claim 16, wherein said pivot pin and said circular cutout are generally disposed at one end of said end edge while said cam means abuts the other end of said end edge.

18. A knife as defined in claim 1, further comprising locking means for positively and releasably locking said blade in the closed position inside said handle.

19. A knife as defined in claim 18, wherein said locking means comprises at least one tine cutout from said handle which projects inwardly into said blade receiving space for engagement with said blade.

20. A knife as defined in claim 19, wherein said blade is provided with a recess for receiving at least a portion of said tine.

* * * * *